US006291749B1

(12) United States Patent
Tseng

(10) Patent No.: US 6,291,749 B1
(45) Date of Patent: Sep. 18, 2001

(54) MECHANICAL MUSICAL MOVEMENT WITH ELECTRONIC LIGHT CONTROL

(75) Inventor: Richard C. F. Tseng, Rowland Heights, CA (US)

(73) Assignee: Kao Mei International, Inc., Walnut, CA (US)

( * ) Notice: Subject to any disclaimer, the term of this patent is extended or adjusted under 35 U.S.C. 154(b) by 0 days.

(21) Appl. No.: 09/714,544

(22) Filed: Nov. 15, 2000

(51) Int. Cl.[7] ..... G10F 1/06

(52) U.S. Cl. ..... 84/95.2; 84/94.1; 84/95.1; 84/600

(58) Field of Search ..... 84/94.1, 94.2, 84/95.1, 95.2, 96–101, 600–602

(56) References Cited

U.S. PATENT DOCUMENTS

| | | | |
|---|---|---|---|
| 4,890,528 | 1/1990 | Kamijima | 84/95.2 |
| 6,124,541 | 9/2000 | Lu | 84/600 |

*Primary Examiner*—Marlon T. Fletcher
(74) *Attorney, Agent, or Firm*—George W Finch

(57) ABSTRACT

A musical movement in which a drum has a series of pins that engage the reeds of a vibration plate to play a tune. The movement includes a cam disk which rotates with the drum. A switch is activated by the cam to energize a circuit for flashing a plurality of lights in pseudo-synchronism with the music played by the musical movement. In that way, the distinctive sound of a mechanical musical movement is combined with efficient, computer controlled flashes from light emitting diodes or high intensity micro incandescents.

18 Claims, 3 Drawing Sheets

MECHANICAL MUSICAL MOVEMENT WITH ELECTRONIC LIGHT CONTROL

BACKGROUND OF THE INVENTION

Mechanical music movements produce a distinctive sound and although originally they were expensive toys for aristocrats in Europe used to reproduce complex tunes, in modern days they normally play a short simplified tune and cost very little. The tune or tune fragment is produced by selectively plucking a plurality of reeds on a vibration plate. Modern musical movements pluck the reeds with pins which extend out of the side of a cylindrical drum which is rotated adjacent the vibration plate.

Various mechanical drivers are used to rotate the drum. For example, in very simple musical movements, the drum is rotated by means of a hand crank and a simple reduction gear. In other movements, a spring motor is included which may be wound by means of a key or a pull string. When a spring motor is provided, a transmission is included between the spring motor and the drum, which includes some sort speed regulator. The regulator can take the form of a fan whose drag increases exponentially with speed to compensate for the variations in forces applied by the spring motor between its fully wound position and its unwound position. Better speed regulation can be obtained through the use of centrifugal brake devices, which spin one or more brake shoes against a fixed drum and are arranged so that faster speeds increase the centrifugal force and cause the brake shoes to engage the drum with more force. In this way, high unwind speeds are avoided since at high speeds the braking device produces much more braking than at low speeds. However, because of cost constraints, neither of the described speed regulators are particularly accurate, they only acting to modulate unwind speed of the spring motor and not really completely control it.

Electronic musical circuits are now available at very low costs. However, such devices produce tones by electronically generating sound signals and then playing them through a speaker. In most applications, there is very little room for a speaker so that low volume and a particularly characteristic electronic sound is produced, which is not as pleasing as the sound produced by traditional mechanical musical movements. Also, mechanical musical movements can have power take off devices to actuate additional features. For example, when a mechanical musical movement is placed within a stuffed bear, a power take off can be provided to the bear's mouth. The result is a stuffed bear who appears to be singing along with the tune produced by the mechanical musical movement.

In recent times, bright multi-colored, light emitting diodes and high intensity micro incandescent lamps have become available. There are applications where it is desirable to provide light outputs at the time a mechanical musical movement is producing a tune. This is very simple to do when an electronic musical circuit is used as the required current outputs from such an electronic circuit are relatively easily implemented. However, as aforesaid, the music produced by such electronic devices is of inferior quality.

Therefore, there has been a need to provide mechanical music movements of normal mechanical configurations, which can control and actuate one or more light sources, especially for use in displays and toys.

SUMMARY OF THE INVENTION

In the present invention, a mechanical musical movement of generally conventional form is provided with a cam or similar mechanically timed actuation device attached to the drum of the mechanical musical movement. In this way, actuations caused by such timing means are generally in synchronism with the music produced by the mechanical musical movement. As aforesaid, since such movements tend to slow down gradually as their spring motor unwinds, or if hand cranked, to run at a speed controlled by the cranker, it can be important to the operation of the present invention that the turning on and turning off of the lights is related to the tune being played, and hence the position of the drum in relation to the vibration plate.

In a preferred embodiment, cam lobes are provided at the end of the drum opposite from its driving gear. The lobes are used to close a mechanical switch, which then in turn activates a light control circuit. The light control circuit may be relatively simple or include a central processing unit (CPU), a memory, and a light driver so that sophisticated patterns of light activation can be produced. In some instances, a single lobe is provided so that the switch activates the light circuit at or near the position of the drum where a tune commences. Thereafter, the light circuit is timed to produced flashes from its connected lights during the approximate time that the tune will be played. In more sophisticated arrangements, multi-lobe cams can be used to generally signal the correct time to change the sequence of flashing lights. This sequence change can be synchronized to the start of the tune by having two closely placed lobes which produce closely spaced signals to the CPU allowing it to determine the start of the tune and to reset for further operations.

Although cam lobes are a suitable activation means, other devices such as protrusions placed on the circular side plate of the drum can be used to activate a reed switch which in this instance would be turned 90°. Other suitable means include magnets in the drum to actuate a magnetic switch and even optical stripes on the end plate for reading by an optical sensor, when the expense the cost of such is justified by the wanted tune matching capability of the device.

Therefore is an object of the present invention to integrate mechanical musical movement technology with modern electronic light controls so that lights can be activated in pseudo-synchronism with the tune being played by the mechanical musical movement.

Another object is to provide means to activate lights in accordance with the progress of a tune being played by a mechanical musical movement.

Another object is to provide integration between a mechanical musical movement and an electronic light control in a very economical way, without requiring substantial modification to existing musical movements.

These and other objects and advantages of the present invention will become apparent to those skilled in the art after considering the following detailed specification together with the accompanying drawings wherein:

DETAILED DESCRIPTION OF THE PREFERRED EMBODIMENTS

Figure 1:
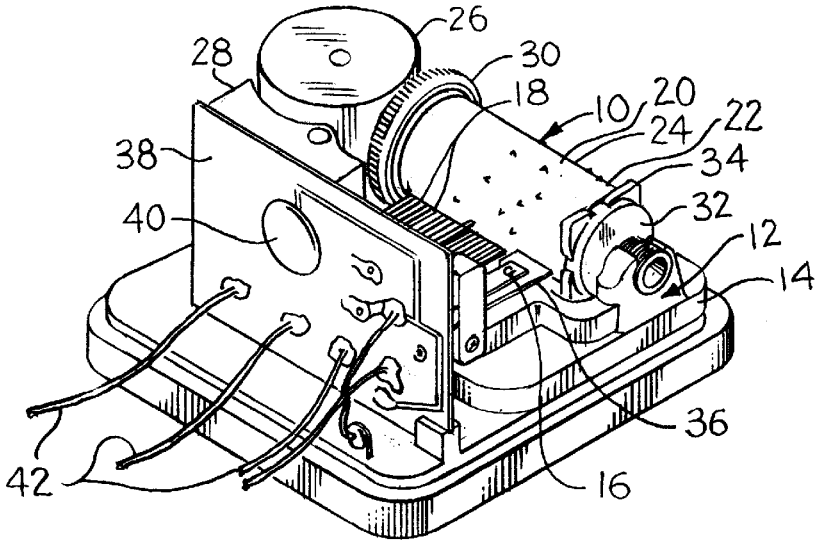
FIG. 1 is a prospective view of a mechanical musical movement incorporating a single lobe cam and an electronic control circuit attached thereto on a printed circuit board.

Referring to the drawings more particularly be reference numbers, number 10 in FIG. 1 refers to a mechanical musical movement with a light controller constructed according to the present invention. The device 10 includes a musical movement 12 having a base 14 which supports a vibration plate 16 having a plurality of reeds 18 formed therein. Generally each reed 18 producing a different tone when plucked by pins 20 extended hourly from the cylindrical surface 22 of a drum 24 which is rotated adjacent the vibration plate 16.

The mechanical musical movement 12 of FIG. 1 includes a spring motor 26, such as are wound by a key, not shown, which through a transmission 28 drives the drum 24 by means of a gear 30 at one end thereof. A cam plate 32 is included at the opposite end of the drum 24 and is shown including a lobe 34 positioned so that a reed switch 36 is closed thereby and then allowed to open as the lobe 34 rotates there past with the drum 24. The device 10 also includes a printed circuit board 38 for feeding electrical power from a battery, not shown, to a light control circuit 40, and distributing the outputs thereof along wires 42 to lights 44 as shown in FIG. 2.

Figure 2:
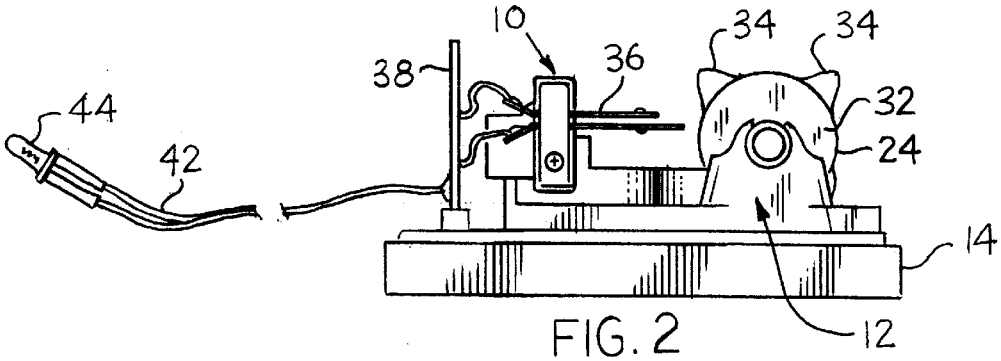
FIG. 2 is a side view similar to FIG. 1 showing an embodiment with multiple cam lobes.
Figure 3:
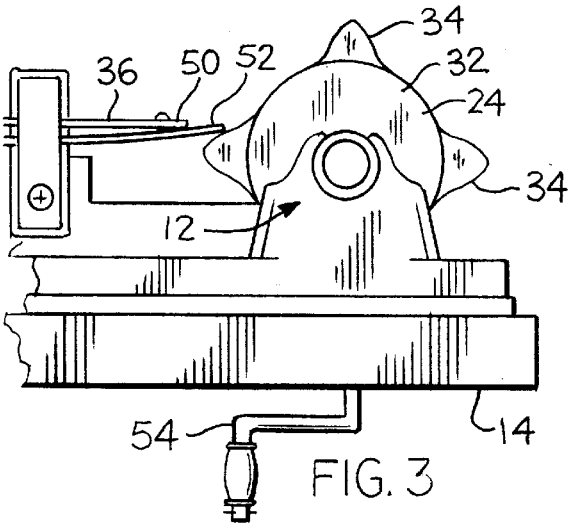
FIG. 3 is an enlarged side view similar to FIG. 2 showing how a cam lobe causes a simple reed switch to energize in a hand cranked version of the present invention.

In FIG. 2, multiple lobes 34 are shown on the cam plate 32 for multiple actuations of the switch 36. As shown, the switch 36 is a normally open switch which is closed by engagement with the cam lobe 34 there past as is shown in FIG. 3 by closing the opposite leafs 50 and 52 thereof. FIG. 3 also shows a movement 12 driven by a hand crank 54.

Figure 4:
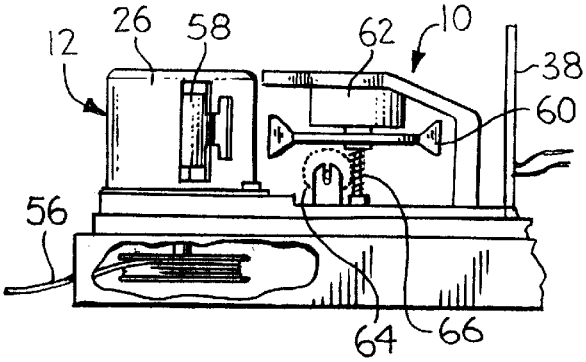
FIG. 4 is an opposite side view of the musical movement of FIG. 1 showing the spring motor, a portion of the speed increasing transmission, a speed regulator in a string pull musical movement.

Whether the movement 12 is hand cranked or driven by a spring motor 26 activated by a key or the pull string 56 shown in FIG. 4, the spring 58 of the spring motor 26 or cranking speed of the user of the hand crank 54, normally varies. Therefore, a speed control mechanism or regulator such as the fan 60 and/or the centrifugal brake assembly 62 are provided in all but the most economical embodiments of the invention so that the tune played by the drum 24 and the vibration plate 16 is not played too fast after winding, nor too slow except at the very end of the unwinding of the spring 58. Normally, such regulator mechanisms are driven by a step up gear shown as a spur gear 64 driving a high angle worm gear 66.

Figure 5:
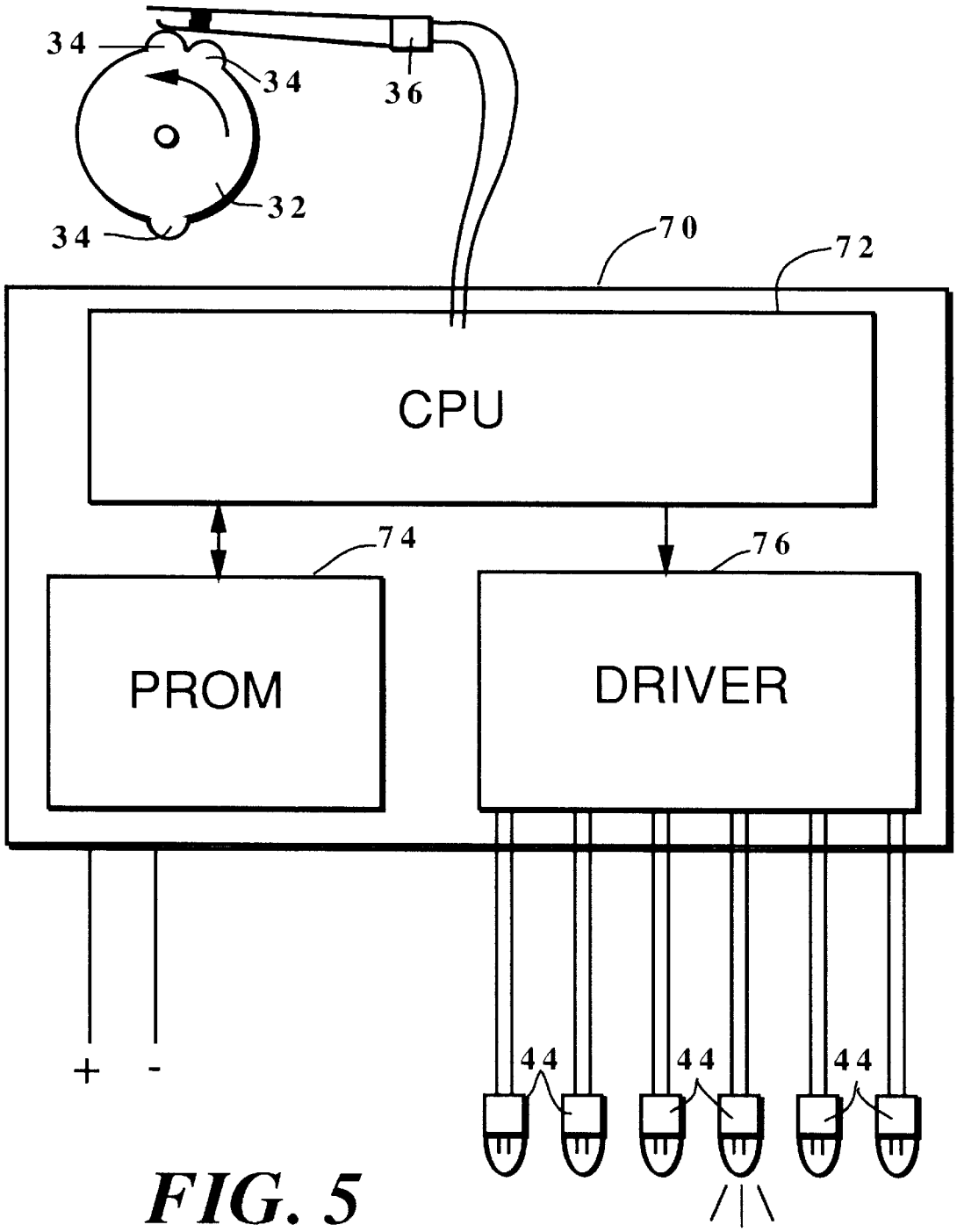
FIG. 5 is a diagrammatic view showing the logic and electrical interconnection between the activation switch, a CPU, a prom memory, a light driver, and a plurality of lights.

In FIG. 5, a light control circuit 70 is shown with its typical components. When the switch 36 is closed and/or opened by a cam lobe 34, a signal is sent to the central processing unit (CPU) 72, which activates it into full operation. At that point, the CPU queries the memory 74, shown as a programmable read only memory (PROM), to access the instructions for lighting the lights 44 and in what sequence. The CPU 72 having determined the proper sequence from the memory 74, provides this information to a light driver 76, which thereafter activates the lights 44 in accordance with the instructions provided. As shown in FIG. 5, two lobes 34 are positioned adjacent each other to produce two signals within a short time. When a suitable CPU 72 is provided, it can sense these two short pulses from the switch 36 and determine that the start of a tune has just occurred, to reset the driver 76 and initialize its sequence. Note that a third lobe 34 is positioned opposite the adjacent lobes 34. This can be used to time a change in the light sequence to correspond, for example, with a dramatic change in the tune being played.

Figure 6:
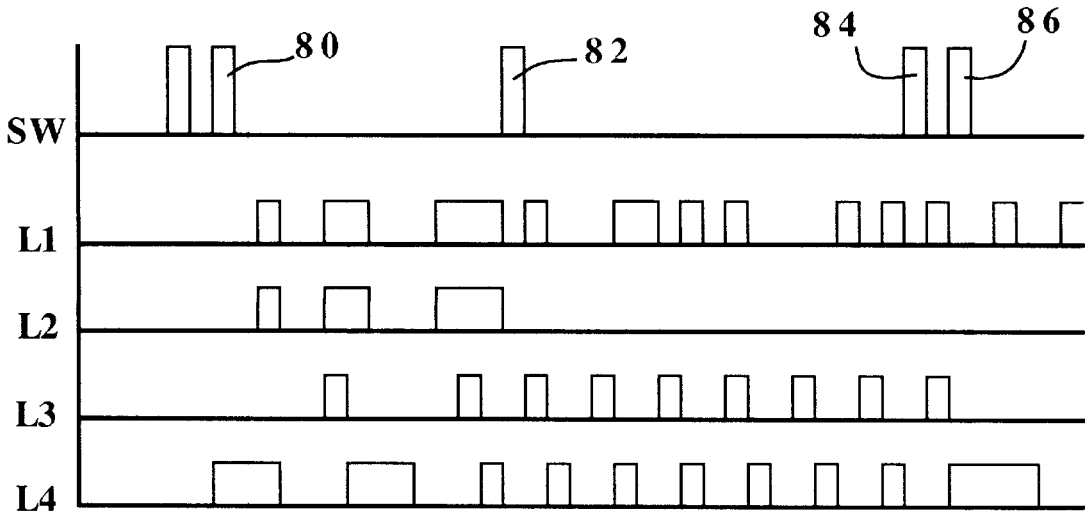
FIG. 6 is a typical timing diagram of switch input versus light output for the device shown in FIG. 5.

This can be understood easier with reference to FIG. 6 wherein the pulses produced by a switch (SW) are compared against the flashing sequence of lights L1, L2, L3 and L4 over time. Note that when the second pulse 80 starts, so does the sequence of L4 and thereafter a pre-determined pattern of light activations of L1, L2, L3 and L4 occur as programmed in the memory 74. When part way through the tune another pulse 82 is produced by the switch then the sequencing of L1, L2, L3 and L4 is changed until the CPU 72 is reinitialized by the two close together pulses 84 and 86. Although the lights are shown as being activated in flashes, one may be turned on for most if not all of the tune while others may just occasionally flash, depending upon the effect desired by the designer and programmed into the PROM 74. Note that even though the lobes 34 in FIG. 5 are almost exactly opposite each other, a longer time is present between pulse 82 and 84 indicating that spring motor 26 is slowing down. For that reason, it is convenient to have the pulses 84 and 86 reinitialize the CPU 72 to bring it back into pseudo-synchronism with the tune being played.

Figure 7:
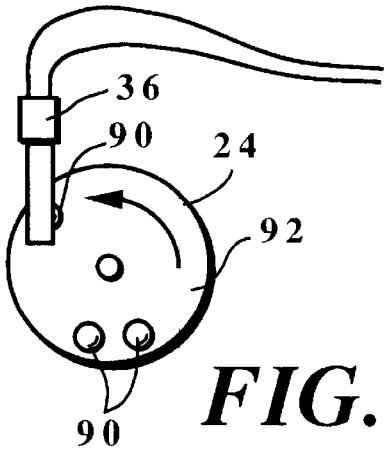
FIG. 7 is a simplified side view showing a mechanical switch being activated by buttons formed on the side of the end of the drum.
Figure 8:
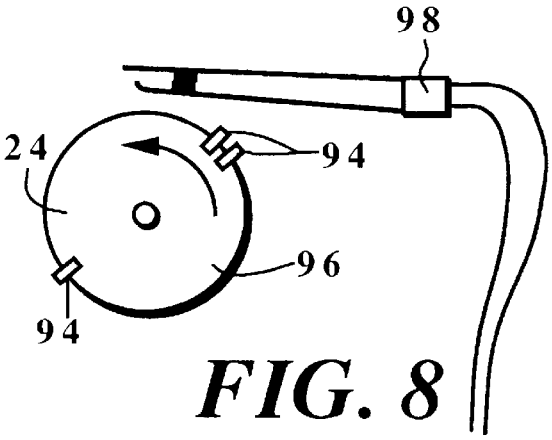
FIG. 8 is a view similar to FIG. 7 showing magnets embedded in the drum to open a normally closed switch.
Figure 9:
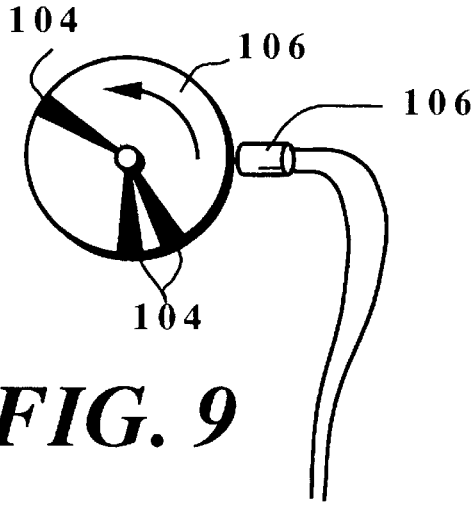
FIG. 9 is a similar side view similar to FIGS. 7 and 8 showing in a simplified way how a light sensor and a pattern on the side of the drum can be used to control the CPU.

FIGS. 7, 8 and 9 show alternate CPU actuation methods. For example, in FIG. 7, the switch 36 has been turned on its side and is being activated by buttons 90 formed in the side surface 92 of the drum 24. In FIG. 8, small magnets 94 are embedded in the end 96 of a drum 24 to open a normally closed magnetic switch 98, whereas in FIG. 9, a light sensor 102 is used to read a pattern of stripes 104 placed on the end 106 of the drum 24. The light sensor 102 is very rarely practical unless the movement 12 is powered by an AC line power source.

Thus, there has been shown and described mechanical musical movements with electronic light actuation means which fulfill all of the objects and advantages sought therefore. Many changes, alterations, modifications, and other uses and applications of the subject invention, become apparent to those skilled in the art after considering the specification together with the accompanying drawings. All such changes, alterations, and modifications which do not depart from the spirit and scope of invention are deemed to be covered by the invention, which is limited only by the claims that follow.

What is claimed is:

1. A mechanical musical movement comprising:

a vibration plate having:

a plurality of reeds, each producing a different musical note when vibrated;

a drum having an axis of rotation and pins extending outwardly from said drum positioned for engagement with said reeds of said vibration plate to play a tune when said drum is rotated;

driving means operatively connected to rotate said drum around said axis of rotation;

a speed regulator operatively connected to said drum to urge said drum to rotate at a relatively constant speed when driven by said driving means;

a cam connected for rotation with said drum;

a switch positioned for activation by said cam as said cam rotates with said drum;

a light control circuit connected to said switch for controlling the activation of at least one light when said switch is activated by said cam.

2. The mechanical musical movement as defined in claim 1 further including:

a first end plate fixed to said drum for rotation with said drum, said first end plate including:

an outer, generally cylindrical surface having:

at least one cam lobe thereon forming said cam, whereby said pins extending outwardly from said drum are fixed in location with respect to said cam lobe so that said at least one light is activated by said light control circuit in general synchronism with the tune played by said pins.

3. The mechanical musical movement as defined in claim 1 further including:

a first end plate fixed to said drum for rotation with said drum, said first end plate including:

an outer, generally cylindrical surface having:

a pair of adjacent cam lobes thereon forming at least a portion of said cam, whereby said pair of adjacent cam lobes cause said switch to provide said light control circuit a pair of activation signals to initialize said light control circuit at a particular point in the tune played by said pins.

4. The mechanical musical movement as defined in claim 1 further including:

a plurality of lights and wherein said light control circuit includes:

a central processing unit connected to said switch for activation;

a memory in which instructions for sequences of light activations are stored, said central processing unit accessing said memory when activated; and light driver means controlled by said central processing unit connected to said plurality of lights to activate said lights in accordance with the instructions stored in said memory.

5. The mechanical musical movement as defined in claim 4 wherein said plurality of lights are light emitting diodes.

6. The mechanical musical movement as defined in claim 1 wherein said driving means include:

a hand crank; and a transmission to couple rotation of said hand crank to said drum.

7. The mechanical musical movement as defined in claim 1 wherein said driving means include:

a spring motor; and a transmission to couple rotation of said spring motor to said drum.

8. The mechanical musical movement as defined in claim 1 further including:

a first end plate fixed to said drum for rotation with said drum, said first end plate including:

an outer, generally cylindrical surface having:

a pair of adjacent cam lobes thereon forming at least a portion of said cam, whereby said pair of adjacent cam lobes cause said switch to provide said light control circuit a pair of activation signals to initialize said light control circuit at the beginning of the tune played by said pins.

9. A mechanical musical movement comprising:

a vibration plate having:

a plurality of reeds, each producing a musical note when vibrated;

a drum having an axis of rotation and protrusions extending outwardly from said drum positioned for engagement with said reeds of said vibration plate to play a tune when said drum is rotated;

driving means operatively connected to rotate said drum around said axis of rotation;

a cam connected for rotation with said drum;

a switch positioned for activation by said cam as said cam rotates with said drum;

a light control circuit connected to said switch for controlling the activation of at least one light when said switch is activated by said cam.

10. The mechanical musical movement as defined in claim 9 further including:

a plate fixed to said drum for rotation with said drum, said plate including:

a surface having:

at least one cam lobe thereon forming said cam, whereby said protrusions extending outwardly from said drum are fixed in location with respect to said cam lobe so that said at least one light is activated by said light control circuit in general synchronism with the tune played by said protrusions.

11. The mechanical musical movement as defined in claim 9 further including:

a plate fixed to said drum for rotation with said drum, said plate including:

a surface having:

a pair of adjacent cam lobes thereon forming at least a portion of said cam, whereby said pair of adjacent cam lobes cause said switch to provide said light control circuit a pair of activation signals to initialize said light control circuit at a particular point in the tune played by said protrusions.

12. The mechanical musical movement as defined in claim 9 further including:

a plate fixed to said drum for rotation with said drum, said plate including:

a surface having:

a pair of adjacent cam lobes thereon forming at least a portion of said cam, whereby said pair of adjacent cam lobes cause said switch to provide said light control circuit a pair of activation signals to initialize said light control circuit at the beginning of the tune played by said protrusions.

13. The mechanical musical movement as defined in claim 9 further including:

a plurality of lights and wherein said light control circuit includes:

a central processing unit connected to said switch for activation;

a memory in which instructions for sequences of light activations are stored, said central processing unit accessing said memory when activated; and light driver means controlled by said central processing unit connected to said plurality of lights to activate said lights in accordance with the instructions stored in said memory.

14. The mechanical musical movement as defined in claim 13 wherein said plurality of lights are light emitting diodes.

15. The mechanical musical movement as defined in claim 13 wherein said plurality of lights are high intensity micro incandescents.

16. The mechanical musical movement as defined in claim 9 wherein said driving means include:

a hand crank; and a transmission to couple rotation of said hand crank to said drum.

17. The mechanical musical movement as defined in claim 9 wherein said driving means include:

a spring motor; and a transmission to couple rotation of said spring motor to said drum.

18. The mechanical musical movement as defined in claim 9 wherein said transmission includes:

a speed regulator operatively connected to said drum to urge said drum to rotate at a relatively constant speed when driven by said spring motor.

* * * * *